United States Patent [19]

Inaba et al.

[11] Patent Number: 4,649,315

[45] Date of Patent: Mar. 10, 1987

[54] CATHODE-RAY TUBE SOCKET

[75] Inventors: Hirofumi Inaba, Yao; Yasumasa Watanabe, Neyagawa, both of Japan

[73] Assignee: Hosiden Electronics Co., Ltd., Osaka, Japan

[21] Appl. No.: 702,759

[22] Filed: Feb. 19, 1985

[30] Foreign Application Priority Data

Aug. 8, 1984 [JP] Japan ..... 59-122211[U]

[51] Int. Cl.[4] ..... H01J 17/00; H01J 21/00

[52] U.S. Cl. ..... 313/325; 339/14 T; 339/145 T; 339/192 T; 361/129; 313/51

[58] Field of Search ..... 313/325, 51; 361/119, 361/129; 339/14 T, 143 T, 192 T

[56] References Cited

U.S. PATENT DOCUMENTS

| | | | |
|---|---|---|---|
| 3,805,108 | 4/1974 | Suzuki | 313/325 |
| 4,199,215 | 4/1980 | Pittman | 339/192 T |
| 4,266,158 | 5/1981 | Uda et al. | 313/325 |
| 4,378,511 | 3/1983 | Simovits | 313/325 |

*Primary Examiner*—Saxfield Chatmon

*Attorney, Agent, or Firm*—Pollock, Vande Sande and Priddy

[57] ABSTRACT

Contact pieces are accommodated respectively in contact housings in a main body portion. Each of the contact pieces has an intermediate portion extending between a contact portion and a terminal portion and force-fitted and held as a first discharge electrode portion in first positioning grooves. An arcuate grounding conductor is disposed on the main body portion and has integral second discharge electrode portions and dust-prevention lug portions. The second discharge electrode portions are held in confronting and spaced relation to the first discharge electrode portions via discharge gap holes formed in a side wall portion of the main body and are force-fitted and held in second positioning grooves. The first and second discharge electrode portions define discharge gaps therebetween. The first and second discharge electrode portions, inner wall surfaces of the discharge gap holes, and the dust-prevention lug portions define discharge gap chambers with the discharge gaps contained therein, the discharge gap chambers being isolated from the exterior.

13 Claims, 16 Drawing Figures

CATHODE-RAY TUBE SOCKET

BACKGROUND OF THE INVENTION

The present invention relates to a cathode-ray tube socket for use in connection between a cathode-ray tube and an electric circuit, and more particularly to a cathode-ray tube having a discharge gap for preventing an overvoltage from being applied by the cathode-ray tube to the electric circuit Prior cathode-ray tubes are disclosed in U.S. Pat. No. 3,251,016 (issued on May 10, 1966) and U.S. Pat. No. 3,636,412 (issued on Jan. 18, 1972), for example. In the disclosed cathode-ray tubes, a grounding conductor is curved arcuately in substantially concentric relation to the arrangement of contacts, and electrode members project from the grounding conductor with a discharge gap left between the electrode members and the contacts. The grounding conductor is positioned with respect to a body of the cathode-ray tube socket, but the electrode members are not positioned independently with respect to the respective contacts. Therefore, a discharge gap of a high dimensional accuracy cannot be produced in the assembled socket. If the discharge gap were to be disposed fully within the socket body to guard against entry of dust, the overall construction would be complicated, or the socket body would have to be constructed of a plurality of assembled members. Otherwise, dust would easily find its way into the discharge gap, causing varying discharging characteristics thereof which lower its reliability.

SUMMARY OF THE INVENTION

It is an object of the present invention to provide a cathode-ray tube socket which can easily be fabricated, has a discharge gap of a high dimensional accuracy, and prevents dust or other foreign matter from entering the discharge gap.

According to the present invention, contact pieces are force-fitted into and held in first positioning grooves in a body of an insulating material, and the positioned contact pieces have portions serving as first discharge electrode portions. The body has second positioning grooves defined therein and spaced a distance from the first positioning grooves, and second discharge electrode portions are force-fitted and positioned in the second positioning grooves. These second electrode portions are integrally united with a grounding conductor which is angularly bent in an arcuate shape. The positioned second electrode portions and the positioned first electrode portions of the contact pieces jointly define discharge gaps therebetween. The first and second electrode portions and the body jointly constitute closed discharge gap chambers so that dust or other foreign matter will not enter the discharge gap chambers.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
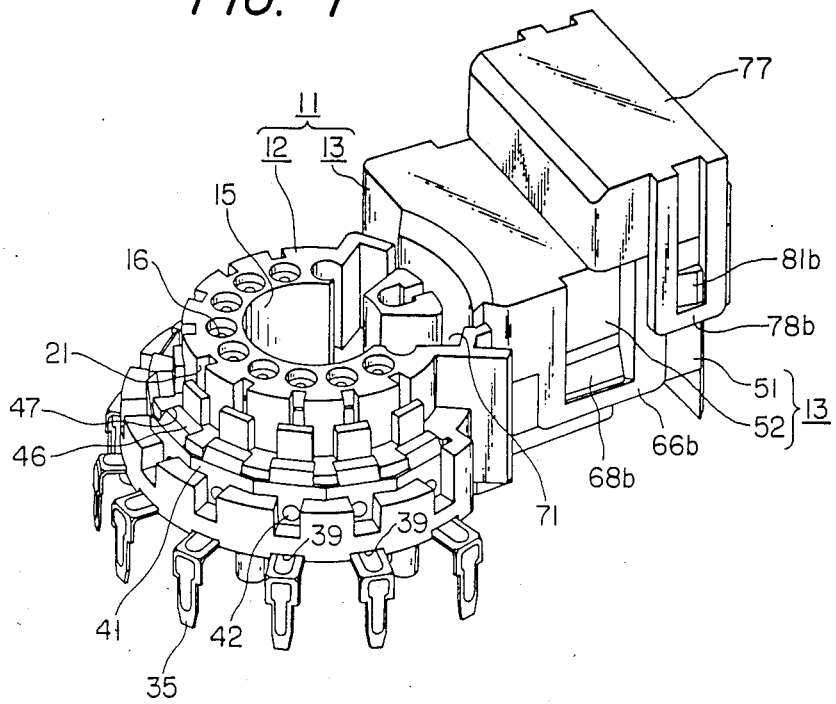
FIG. 1 is a perspective view of a cathode-ray tube socket according to the present invention.

As illustrated in FIGS. 1 through 4, a body 11 of an insulating material is composed of a main body portion 12 in which terminal pins of a companion cathode-ray tube (CRT) will be inserted, and a high-voltage discharge gap chamber 13 integral with a side of the main body portion 12. Although the main body portion 12 of the practical embodiment of the CRT socket has rather a complex shape formed by many recesses and projections as seen from FIGS. 1, 1A and 1B, a simplified basic structure of the main body 12 comprises a center cylindrical tube **12*a*, a first cylindrical side wall 12*b* disposed outside the center cylindrical tube 12*a* concentrically therewith, a front annular wall 12*c* connecting both front ends of the first cylindrical side wall 12*b* and the center cylindrical tube 12*a*, a second cylindrical side wall 12*d* disposed outside the center cylindrical tube 12*a* concentrically therewith and behind the first cylindrical side wall 12*b*, the outer diameter of the second cylindrical side wall 12*d* being larger than that of the first one 12*b*, an intermediate annular step wall portion 12*e* connecting a rear end of the first cylindrical side wall 12*b* and a front end of the second cylindrical side wall 12*d* to form a stepped portion of the socket, and a plurality of partition walls 12*f* disposed in parallel to the axis of the center cylindrical tube 12*a* at regular angular intervals to radially extend from the outer peripheral surface of the center cylindrical tube 12*a* to the inner peripheral surfaces of the first and second cylindrical side walls 12*b*, 12*d*, thereby forming a plurality of contact housings 17. Through holes 25 are made in the second cylindrical side wall 12*d* to communicate therethrough the respective contact housings 17 with the outside, of the main body portion 12 defining discharge chamber holes 25. According to the present invention, positioning grooves 23, 26 are provided both inside and outside of the second cylindrical side wall 12***d* near the respective through holes 25. Two discharge electrode faces 33, 42 are fixedly positioned in the respective inner and outer positioning grooves 23, 26 in opposing relation to each other via each through hole 25 to close the through hole from the respective inner and outer sides of the second cylindrical side wall 12*d*, thereby forming a substantially closed discharge chamber 25'. One of the two discharge electrode faces 33, 42 is a portion 33 of a contact piece 28 accommodated in the contact housing 17 and either one of the two discharge electrode faces 33, 42 has a semispherical projection 48 formed therein by a press to oppose the other discharge electrode face, thereby defining therebetween a discharge gap.

Now, detailed explanations of a specific embodiment of the CRT socket according to the present invention will be given. The main body portion 12 is substantially of a thick circular shape having a circular hole 15 of the center cylindrical tube 12*a* defined therethrough in coaxial relation to a central axis 14. The main body portion 12 has a plurality of terminal pin insertion holes 16 formed in the front annular wall 12*c* defining a front face at equal intervals along a circle concentric with the central axis 14 for the insertion of the terminal pins of the cathode-ray tube. The main body portion 12 also has the contact housings 17 (FIG. 4) communicating respectively with the terminal pin insertion holes 16 and extending in an axial direction to the rear (i.e. the bottom in FIGS. 1 and 4) of the body 11. The contact pieces 28 (FIG. 7) are accommodated respectively in the contact housings 17 so that contact portions 18 of the contact pieces 28 are fitted in narrow portions of the housings 17 adjacent to the terminal pin insertion holes 6. Each of the contact housings 17 has an expanded portion 19 outwardly expanding, at a position behind the contact portion 18, away from the central axis 14. The main body portion 12 also has an engagement recess 21 defined in an inner wall surface of the first cylindrical side wall 12*b* at the narrow portion of each contact housing 17, the engagement recess 21 being positioned adjacent the radially outer face of the contact portion 18 away from the central axis 14. The engagement recess 21 extends parallel to the central axis 14 rear to the expanded portion 19 of the contact housing 17 where the recess 21 ends to form an engagement step portion 22 as shown in FIG. 1B. In the illustrated embodiment, no contact piece is accommodated in the contact housing 17 at an end of the circular arrangement of the contact housings 17 as seen from FIG. 3.

Figure 5:
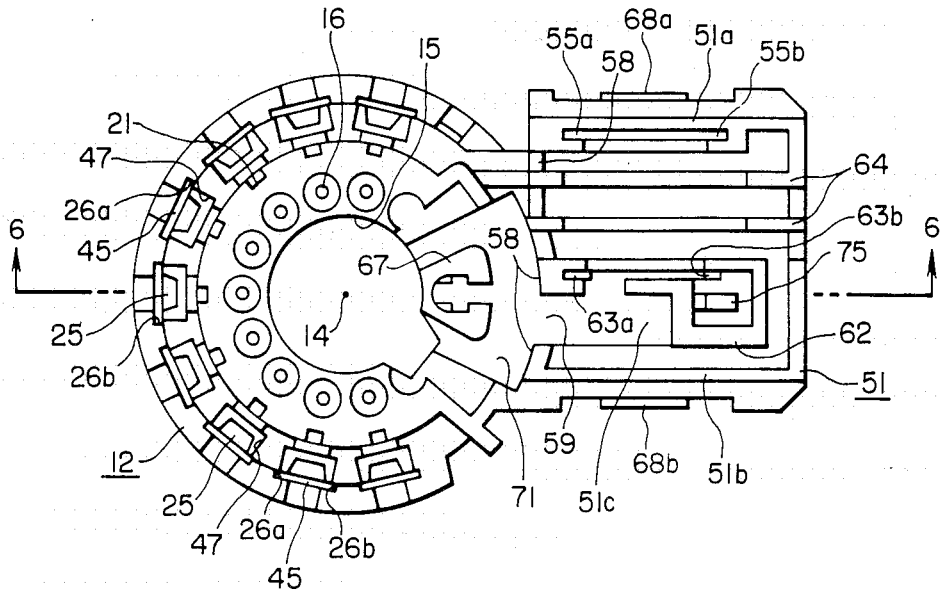
FIG. 5 is a plan view of the main body portion illustrated in FIG. 2.
Figure 6:
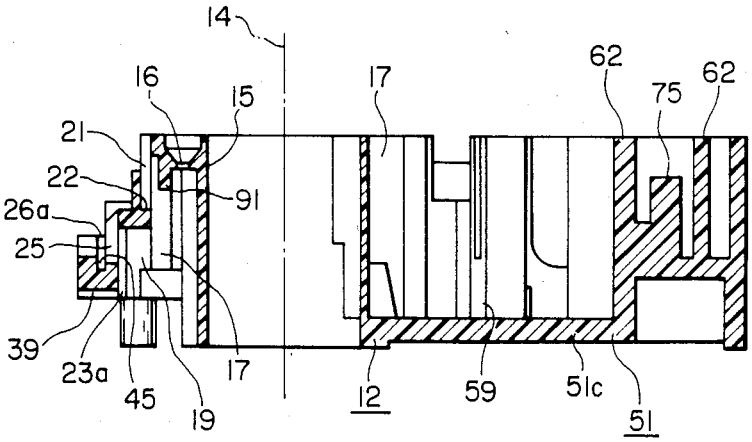
FIG. 6 is a cross-sectional view taken along line 6—6 of FIG. 5.

Positioning grooves 23*a*, 23*b* are formed in opposing relation to each other at corners where the opposing partition walls 12*f* meet the inner surface of the second cylindrical side wall 12*d* as shown in FIGS. 1B and 6, the positioning grooves 23*a*, 23*b* extending in a direction along the central axis 14 of the main body portion 12 to reach an inner wall surface of the intermediate annular step wall 12*e*. Between the positioning grooves 23*a*, 23*b*, there is formed in the second cylindrical side walls 12*d* the discharge gap chamber hole 25 communicating therethrough the contact housing 17 with the outside of the body portion 12. The main body portion 12 has a smaller outside diameter at a front side relative to the arrangement of the discharge gap chamber holes 25. A pair of positioning grooves 26*a*, 26*b* (FIGS. 1A and 5) are provided on the outer surface of the second cylindrical side wall 12*d* on both sides of each discharge gap chamber hole 25 in opposing relation to each other, the positioning grooves 26*a*, 26*b* extending in parallel to the central axis 14. Thus, the positioning grooves 23*a*, 23*b* are arranged along one circle concentric with the central axis 14, while the positioning grooves 26*a*, 26*b* are arranged along another circle concentric with the central axis 14 in radially outward relation to the positioning grooves 23*a*, 23*b*.

Figure 4:
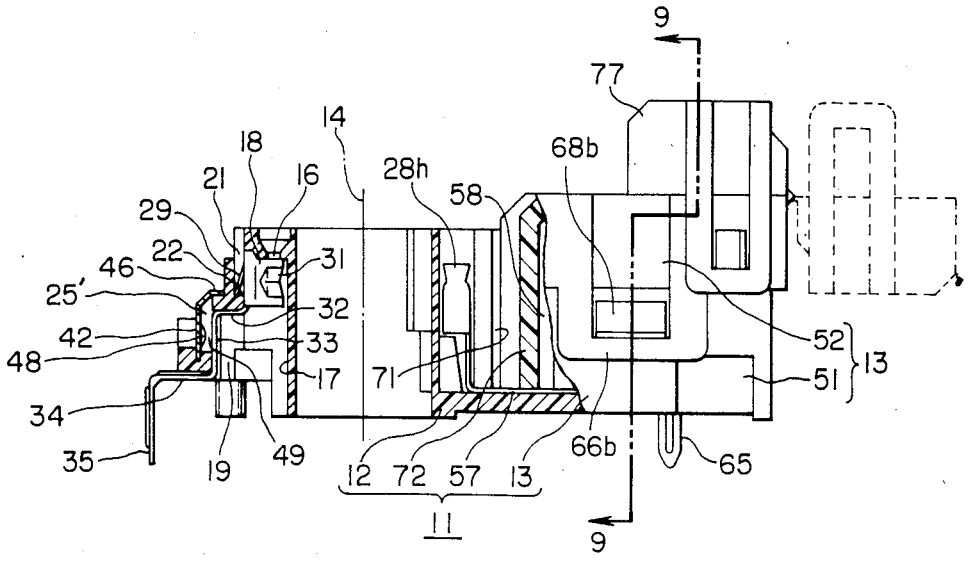
FIG. 4 is a longitudinal cross-sectional view of a main body portion of the socket of FIG. 2.
Figure 4A:
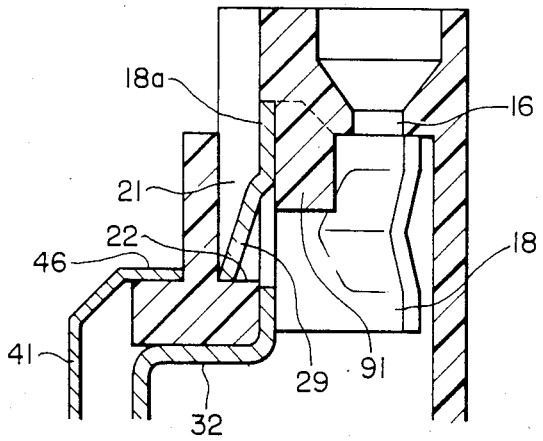
FIG. 4A is an enlarged cross-sectional view of a holder for a contact portion 18.
Figure 7:
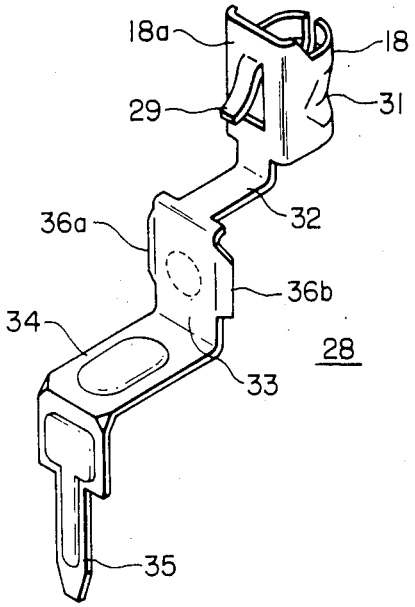
FIG. 7 is an enlarged perspective view of a contact piece 28.

As shown in FIGS. 4 and 7, each of the contact pieces 28 received in the contact housings 17, respectively, is produced by cutting and bending a single metal strip. The contact portion 18 is formed by bending a T-shaped end of the metal strip into a substantially tubular shape. The contact portion 18 has a flat face 18*a* remote from the central axis 14, in which is formed a small engagement finger 29 raised integrally therefrom as by slitting. The flat face 18*a* is held in plane-to-plane contact with the inner wall surface of the first cylindrical side wall 12*b* such that the small engagement finger 29 projects into the engagement recess 21 and the tip of the finger 29 engages the engagement step portion 22 for anchoring the contact piece 28 against removal (FIGS. 4 and 4A). The tubular contact portion 18 has an intermediate portion pressed and displaced inwardly, to form a resilient receptacle 31 for resiliently receiving the terminal pin inserted through the insertion hole 16. As illustrated in FIGS. 1B and 4A, a front end of the flat face 18*a* is fitted in between a projection 91 and the inner wall surface of the side wall 12*b* to keep the contact portion 18 from radial movement relative to the axis 14 upon insertion and removal of the cathode-ray tube terminal pin.

The contact piece 28 has a neck portion 32 extended from the contact portion 18 and bent outwardly along an inner wall surface of the intermediate annular step wall 12*e*. The engagement step portion 22 is sandwiched between the neck portion 32 and the finger 29 of the contact piece 28, so that the contact piece 28 is fixed in place in the direction parallel to the axis 14 so as to be positioned stably upon insertion and removal of the terminal pins. The neck portion 32 has an outer end from which a discharge electrode portion 33 extends rearwardly along an inner wall surface of the second cylindrical side wall 12*d*. The discharge electrode portion 33 has a rear end from which an outer extension 34 extends radially outwardly away from the central axis 14 along a rear surface of the main body portion 12. A terminal 35 extends integrally rearwardly from a rear end of the outer extension 34.

Figure 3:
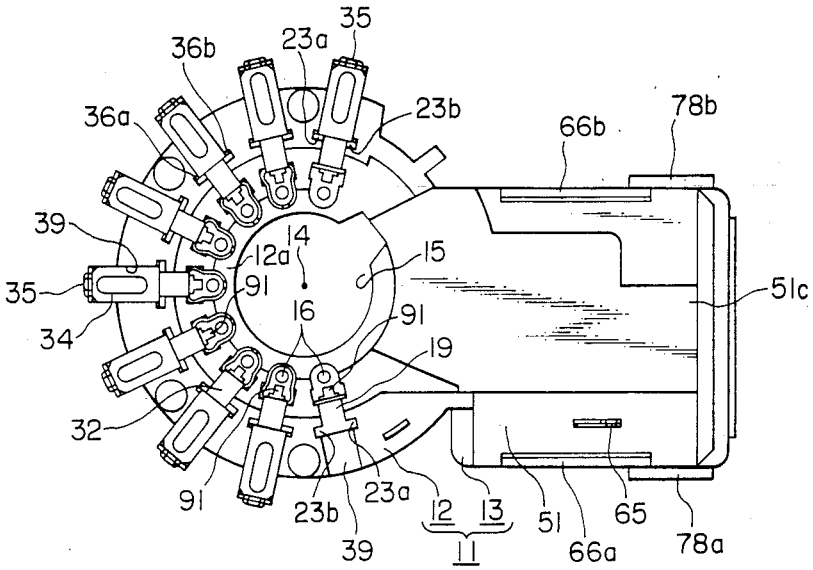
FIG. 3 is a bottom view of the socket shown in FIG. 1.
Figure 3A:
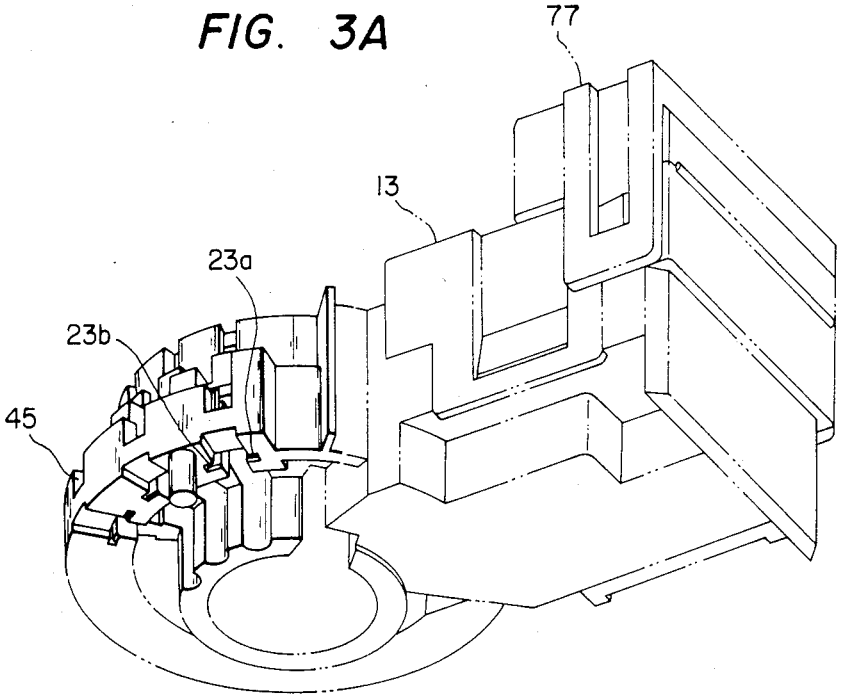
FIG. 3A is a rear perspective view of the socket shown in FIG. 1.

The discharge electrode portion 33 has on opposite sides thereof engagement flanges 36*a*, 36*b* projecting in a width direction thereof and being slightly bent toward the central axis 14 obliquely to the face of the discharge electrode portion 33. The engagement flanges 36*a*, 36*b* have the front edges inclined for facilitating insertion thereof into the positioning grooves 23*a*, 23*b*. For assembly, the engagement flanges 36*a*, 36*b* are force-fitted respectively into the positioning grooves 23*a*, 23*b* from behind the main body portion 12 to cause the discharge electrode portion 33 to tightly close the discharge gap chamber hole 25 on the side of the inner surface of the second cylindrical side wall 12*d* owing to a biasing force of the bent engagement flanges 36*a* 36*b* against the chamber hole 25. As shown in FIGS. 3 and 4, the outer extension 34 of the contact piece 28 is substantially fitted in each of radially extending recesses 39 defined in the rear end surface of the second cylindrical side wall 12*d*.

Figure 2:
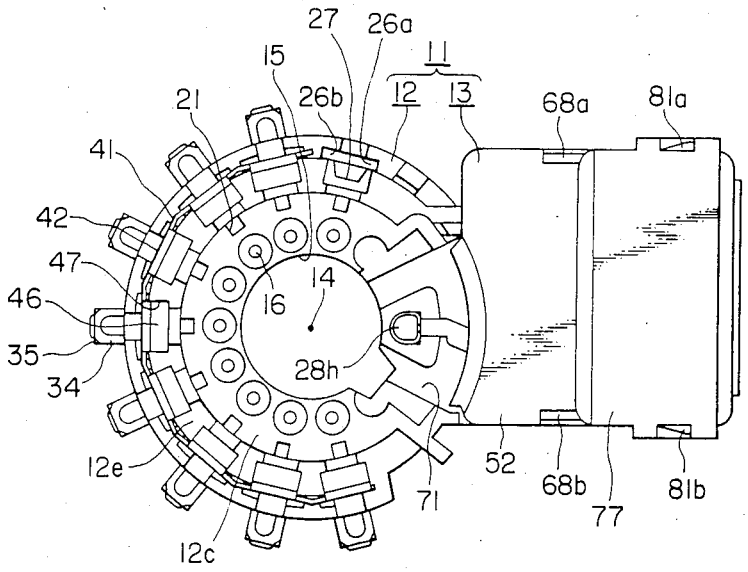
FIG. 2 is a plan view of the socket shown in FIG. 1.
Figure 1A:
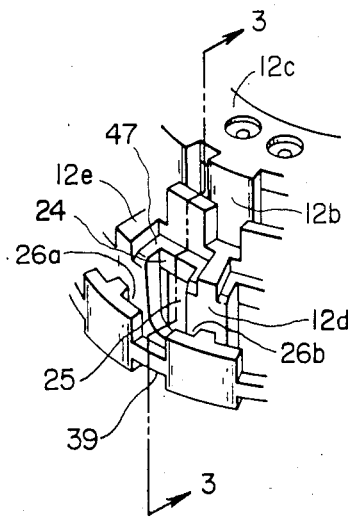
FIG. 1A is a perspective view of a part of the socket shown in FIG. 1, where contact pieces and a grounding conductor are removed.
Figure 1B:
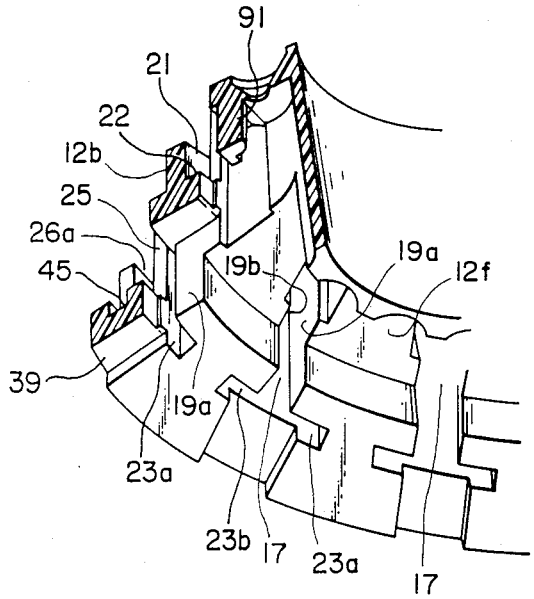
FIG. 1B is a perspective view of a part of the socket shown in FIG. 1A which is cut along line 3—3 and seen aslant from the bottom.
Figure 1C:
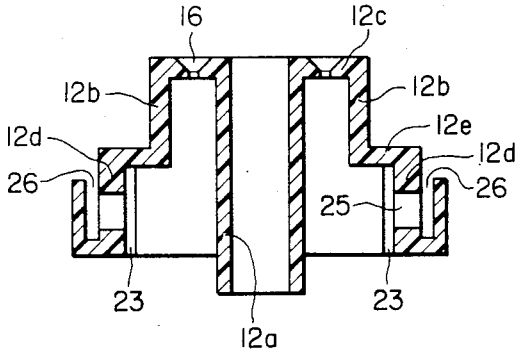
FIG. 1C is a cross-section showing a basic construction of a main body portion 12 of the socket according to the present invention.
Figure 8:
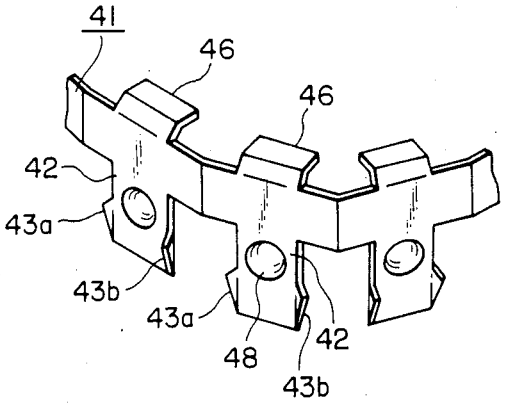
FIG. 8 is an enlarged perspective view of a grounding conductor 41.

As shown in FIGS. 1, 2 and 8, a grounding conductor 41 is bent from a strip-shaped conductive member into an arcuate form extending along an outer peripheral surface of the main body portion 12 and having its width direction parallel to the central axis 14. From one marginal side of the grounding conductor 41 a plurality of discharge electrode portions 42 extend in a width direction thereof. Each of the discharge electrode portions 42 has opposite engagement edges 43*a*, 43*b* extending from both sides thereof, the engagement edges 43*a*, 43*b* being bent slightly obliquely and radially outwardly away from the central axis 14. The engagement edges 43*a*, 43*b* are tapered so that the distance therebetween is progressively reduced toward a distal end of the discharge electrode portion 42. The engagement edges 43*a*, 43*b* are force-fitted into the positioning grooves 26*a*, 26*b*, respectively, from the front side of the main body portion 12 to position the discharge electrode portion 42. As thus assembled, the discharge electrode portion 42 tightly closes the discharge gap chamber hole 25 on the side of the outer peripheral surface of the second cylindrical side wall 12*d* owing to a biasing force of the bent engagement edges 43*a*, 43*b* against the chamber hole 25. The distal end of each discharge electrode portion 42 is fitted in a slot 45 formed integrally with the positioning grooves 26*a*, 26*b* adjacent a rear edge portion of each discharge gap chamber hole 25.

The grounding conductor 41 has a plurality of dust-prevention lugs 46 each of which projects integrally from the other marginal side thereof and is bent toward the central axis 14 to close a guide recess 24 formed in the peripheral surface of the second cylindrical side wall at a boundary portion between the hole 25 and the outer surface of the intermediate annular step wall 12*e* to communicate therebetween. A plurality of shallow fitting recesses 47 are formed in the outer surface of the intermediate annular step wall 12*e* so as to surround marginal edges of the corresponding guide recesses 24. The dust-prevention lugs 46 are fitted respectively in the fitting recesses 47 to close the guide recesses 24. The guide recesses 24 are provided to allow passage therealong of semispherical projections 48 formed integrally with the respective electrode portions 42 at the centers thereof when the electrode portions 42 are fitted into the positioning grooves 26*a*, 26*b*. The electrode portion 33 of the contact piece 28, the electrode portion 42 of the grounding conductor 41, the dust-prevention lug 46, and the inner wall surface of the discharge gap chamber hole 25 jointly constitute a discharge gap chamber 25'. A discharge gap 49 is defined between each electrode portion 33 and the semispherical projection 48 projecting from the corresponding electrode portion 42 toward the electrode portion 33. The grounding conductor 41 has substantially flat portions where the electrode portions 42 and the dust-prevention lugs 46 project in opposite directions. Therefore, the grounding conductor 41 has a substantially polygonal shape.

With the cathode-ray tube socket of the present invention, the discharge electrode portions 33 of the contact pieces 28 are force-fitted into the respective positioning grooves 23*a*, 23*b*, with the discharge gaps 49 being defined between the positioned electrode portions 33 and 42. The discharge electrode portions 42 are also fixedly positioned by force-fitting them into the positioning grooves 26*a*, 26*b*. The body 11 is molded of a synthetic resin material with a high dimensional accuracy. Therefore, the distance between the discharge electrode portions 33 and 42 can be of a high accuracy, and so is the length of the discharge gap 49. The electrode portions 42 of the grounding conductor 41 are simultaneously positioned simply by force-fitting the grounding conductor 41 from the front side of the body 11, and the contact pieces 28 are positioned by force-fitting thereof from the rear side of the body 11. Therefore, the parts can be assembled in a simple operation. The body 11 is a single construction, rather than an assembly of two front and rear halves, with the discharge gap chambers 25' being not defined by the body 11 itself. The discharge gap chambers 25' are closed by the electrode portions 33, 42 and the dust-prevention lugs 46 to guard against entry of dust through the guide recesses 24 and hence a reduction in operation reliability. The closed discharge gap chambers 25' are automatically constructed by force-fitting the contact pieces 28 and the electrode portions 42 in position. With the grounding conductor 41 being composed of a strip-shaped conductor angularly bent around the central axis 14, the material required of the grounding conductor 41 and the electrode portions 42 can be more effectively used than would be the case with a grounding conductor constructed as a ring-shaped strip with its transverse direction normal to the central axis 14. Accordingly, the socket can be of a reduced outside diameter. The contact pieces 28 may be of a so-called bifurcated type.

Figure 9:
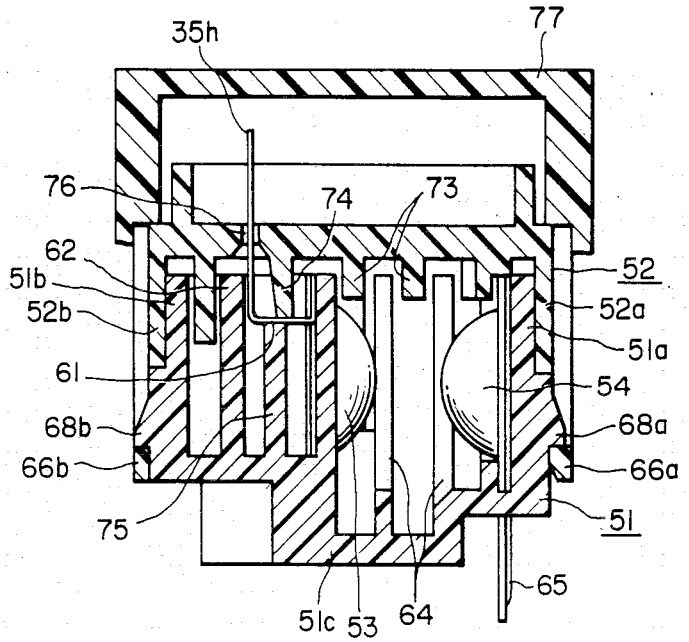
FIG. 9 is a cross-sectional view taken along line 9—9 of FIG. 4.
Figure 10:
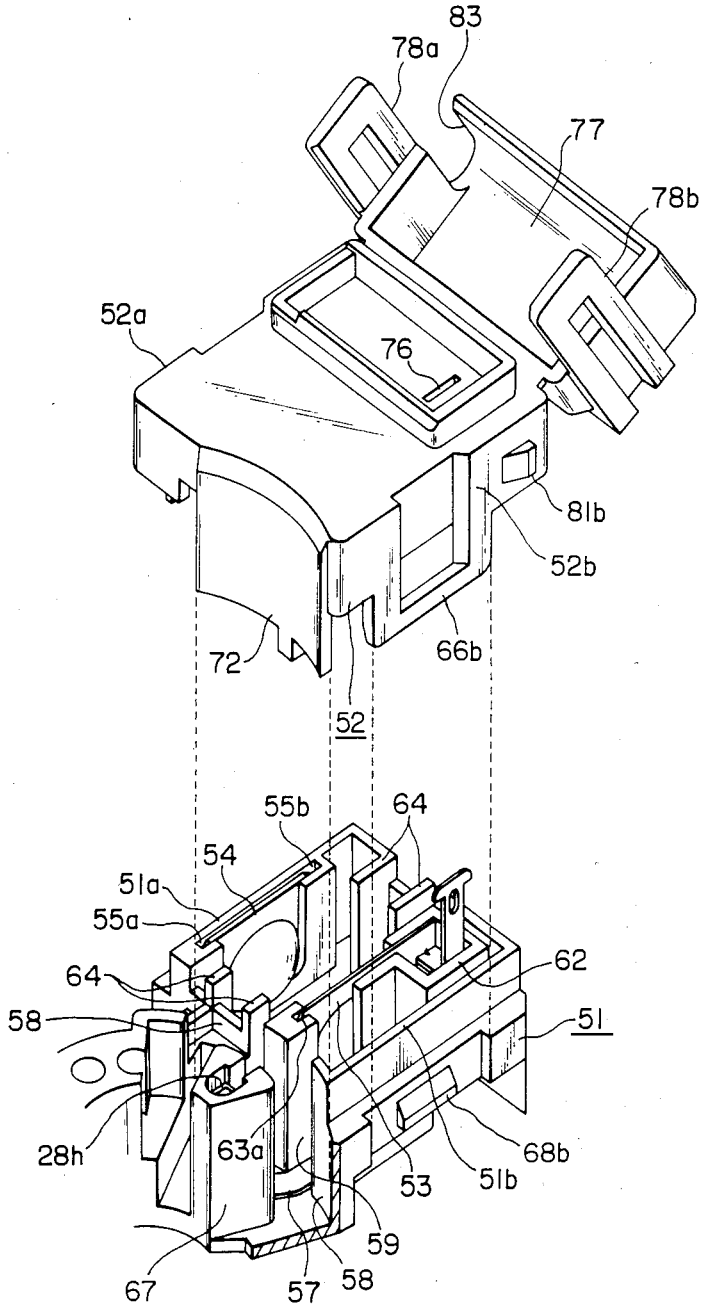
FIG. 10 is an exploded perspective view of a box member and a cover member.

The high-voltage chamber 13 of the body 11 will now be described. As shown in FIGS. 1, 9 and 10, the high-voltage chamber 13 is composed of a square box member 51 integrally projecting from a side of the main body member 12, and a cover member 52 closing a front opening in the box member 51. High-voltage discharge electrodes 53, 54 are disposed in the box member 51 in confronting relation to each other. These high-voltage discharge electrodes 53, 54 comprise square metal plates having central semispherical protuberances projecting toward each other with a high-voltage discharge gap defined therebetween. In the illustrated embodiment, the electrode 53 extends substantially centrally in the box member 51 in a direction parallel to the central axis 14, while the electrode 54 is held against a side wall 51*a* of the box member 51 which faces the electrode 53. The electrode 54 has opposite edges guided and held in support grooves 55*a*, 55*b* defined in the side wall 51*a* and extending in the direction parallel to the central axis 14.

Figure 11:
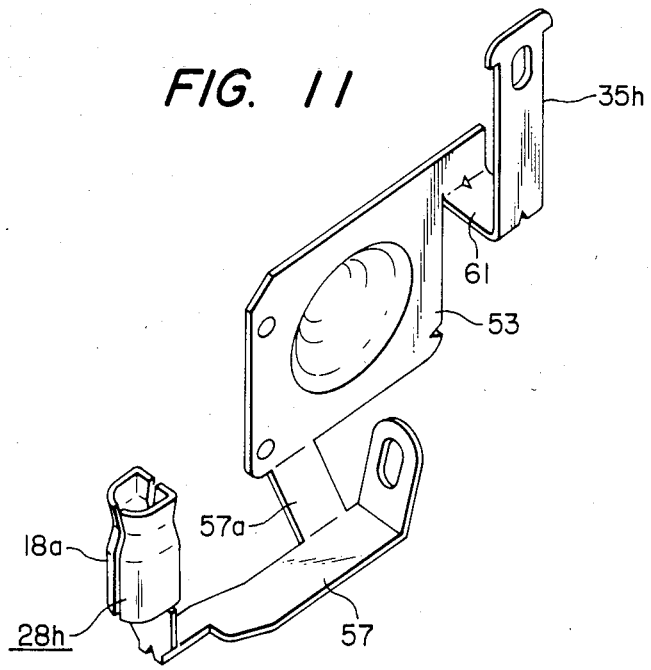
FIG. 11 is an enlarged perspective view of a high-voltage contact piece and a high-voltage discharge electrode.

One of the contact pieces 28 closest to the high-voltage chamber 13 serves as a high-voltage contact 28*h*, which, as shown in FIGS. 4 and 11, is formed integrally with the high-voltage discharge electrode 53. The high-voltage contact 28*h* includes a contact portion 18*a* having a rear end extending rearwardly and from which a connecting portion 57 is bent substantially at a right angle toward the high-voltage chamber 13. The connecting portion 57 passes through a passage 59 defined in a partition 58 between the main body portion 12 and the box member 51 into the high-voltage chamber 13, as shown in FIG. 10. The connecting portion 57 extends along an inner surface of a rear plate 51*c* of the box member 51. The connecting portion 57 is positioned on one side of the electrode 53 opposite from the electrode 54, and includes a neck portion 57*a* (FIG. 11) extending obliquely in a forward direction (i.e. in an upper direction in FIGS. 10, 11) toward the electrode 53 and integrally joined to a rear edge of the electrode 53. The electrode 53 is connected to a high-voltage front terminal 35*h* extending in the forward direction remotely from the high-voltage contact 28*h* and the electrode 54.

The electrode 53 is coupled to the high-voltage front terminal 35*h* by a bent portion 61 which is substantially surrounded by a rectangular tubular wall 62 integrally projecting from the rear plate 51*c*. The opposite edges of the electrode 53 are held in a support slot 63*a* defined in the partition 58 and a slot 63*b* formed in the rectangular tubular wall 62. Ribs 64 are disposed on inner surfaces of the box member 51 between marginal edges of the electrodes 53 and 54 for increasing the creeping distance. The electrode 54 has a terminal 65 projecting rearwardly from the rear plate 51*c* of the box member 51 as shown in FIG. 4.

The cover member 52 is substantially fitted over a front outer peripheral surface of the box member 51. As illustrated in FIGS. 9 and 10, locking members 66*a*, 66*b* of a V-shaped cross section extend integrally rearwardly from rear ends of side plates 52*a*, 52*b* of the cover member 52 which are held respectively against confronting side walls 51*a*, 51*b* of the box member 51. Tapered ridges 68*a*, 68*b* are integrally formed on outer surfaces of the side walls 51*a*, 51*b*, the tapered ridges 68*a*, 68*b* progressively projecting laterally toward the rear ends thereof. The cover member 52 is fixed to the box member 51 when the locking members 66*a*, 66*b*, are locked by the tapered ridges 68*a*, 68*b*. As shown in FIG. 1, the main body portion 12 has a high-voltage protective groove 71 defined in a front surface thereof in surrounding relation to the high-voltage contact 28*h*, the protective groove 71 communicating with the central hole 15. A protective member 72 (FIG. 10) is inserted in the protective groove 71 and held against the partition 58. The protective member 72 is integral with the cover 52 and closes the passages 59 while pressing the connecting portion 57 against the rear plate 51*c* (FIG. 4). As shown in FIG. 9, a plurality of ribs 73 are integrally formed with the cover member 52 between the electrodes 53 and 54 to increase the creeping distance along an inner surface of the cover member 52 between the electrodes 53 and 54. A presser projection 74 is integrally formed on an inner surface of the cover member 52 for pressing the bent portion 61 rearwardly against a projection 75 integrally projecting from the rear plate 51*c*.

The high-voltage terminal 35*h* projects out of the cover member 52 through a small hole 76 defined in the cover member 52. In the illustrated embodiment, the high-voltage terminal 35*h* is shielded by a protective cover 77 molded of synthetic resin integrally with an edge of the cover member 52 remotely from the main body portion 12 so that the protective cover 77 will be angularly movable about the joined edge. When the protective cover 77 is turned into confronting relation to the front surface of the cover member 52, U-shaped locking members 78*a*, 78*b* formed integrally with the protective cover 77 are locked on locking ridges 81*a*, 81*b* (FIG. 2) on the side plates 52*a*, 52*b* of the cover member 52. The protective cover 77 has a recesss 83 through which a lead wire connected to the high-voltage terminal 35*h* can be led out of the protective cover 77.

When the electrode portions 33 and 42 of the contact pieces 28 and the grounding conductor 41 are respectively force-fitted into the main body portion 12, they are automatically positioned in confronting relation with distance gaps of a prescribed length defined therebetween. Since the discharged gap chambers 25' can be closed off the exterior by the electroce portions 33, 42, and the inner surfaces of the discharge gap chamber holes 25, the dust-prevention lugs 46 may be dispensed with.

As mentioned before, the guide recesses 24 are required for allowing the passage of the semispherical projections 48 as long as the discharge electrode portions 42 are inserted into the positioning grooves 26*a*, 26*b* in the direction of the axis 14, and these guide recesses 24 must be covered with the lugs 46 for dust-prevention. However, in the case where the electrode portions 42 are forcibly mounted on the main body member 12 to close one of the openings of the holes 25 in the direction in which the semispherical projections 48 project, the guide recesses 24 are not needed and the dust-prevention luge 46 may be dispensed with.

Semispherical projections may be formed on the electrode portions 33 of the contact pieces 28, as indicated by the broken lines in FIG. 7. With such an alternative, the semispherical projections 48 on the electrode portions 42 may be replaced by flat electrodes and those guide recesses 24 are not required anymore. Therefore, the dust-prevention lugs 46 as well as the fitting recesses 47 may also be dispensed with. However, it will be necessary to form guide recesses in the inner surface of the second cylindrical side wall 12*d* along and between the positioning grooves 23*a* and 23*b* at the respective contact housing 17, thereby allowing the semispherical projections on the electrodes 33 to pass therethrough when the latter are to be force-fitted into the positioning grooves 23*a*, 23*b*. Such guide recesses may be closed by the outer extensions 34 of the contact pieces 28 shown in FIG. 7, which double as duct-prevention lugs.

Although a certain preferred embodiment has been shown and described, it should be understood that many changes and modifications may be made therein without departing from the scope of the appended claims.

What is claimed is:

1. A cathod-ray tube socket comprising:

(a) a disc-shaped main body portion fabricated of an insulating material, said main body portion defining a plurality of contact housing therein at equal angular intervals along a circle concentric with a center axis of said main body portion, a cylindrical side wall portion defining radially outer side wall portions of respective ones of said contact housings in parallel to said center axis, a circular front face wall formed at a front end of said cylindrical side wall portion integrally therewith, said circular front face wall having a plurality of terminal pin insertion holes extending therethrough into communication with corresponding ones of said contact housing, a plurality of discharge gap holes extending through respective ones of said outer side wall portions to communicates said contact housing with the outside of said cathode-ray tube socket, first positioning grooves defined on inner surfaces of said outer side wall portions adjacent said discharge gap holes to extend in parallel to said center axis, and second positioning grooves defined on outer surfaces of said outer side wall portions adjacent said discharge gap holes to extend in parallel to said center axis in opposing relation to said first positioning grooves;

(b) a plurality of contact pieces accommodated respectively in said contact housing, each of said contact pieces being fabricated of a metal strip which is shaped to define a contact portion for resiliently contacting a terminal pin of a cathode-ray tube, a terminal portion integral with said contact portion and projecting out of said main body portion, and an intermediate portion which connects said contact portion to said terminal portion and which is force-fitted into and held in a corresponding one of said first positioning grooves in parallel to said center axis to serve as a first discharge electrodes portion; and (c) a grounding conductor fabricated of a metal strip which is disposed substantially arcuately around said central axis and mounted on said main body portion, said grounding conductor having a plurality of integral second discharge electrodes portions that are force-fitted into and positioned in said second positioning grooves in confronting relation to said first discharge electrode portions, respectively, to define discharge gaps between said first and second discharge electrode portions, said first and second discharge electrode portions and the inner wall surfaces of said discharge gaps holes jointly defining discharge gap chambers which contain said discharge gaps therein and are isolated from the exterior of said cathode-ray tube socket.

2. A cathod-ray tube socket according to claim 1, wherein each of said second discharge electrode portions has a dust-prevention lug portion extended integrally from a marginal edge thereof and bent toward said central axis and also has a semispherical projection projecting toward said center axis substantially at center of said second discharge electrode portion, and guide recesses are formed in the outer surfaces of said outer side wall portions to extend in parallel to said center axis to reach respective said discharge gap holes, so that when said second discharge electrode portions are inserted into said second positioning grooves, said semispherical projections pass through said guide recesses into respective said discharge gap holes and said dust-prevention lug portions close respective said guide recesses.

3. A cathode-ray tube socket according to claim 1, wherein each of said first discharge electrode portions has a dust-prevention lug portion bent outwardly relative to said center axis and extended integrally from one side thereof opposite from said contact portion and has a semispherical projection projecting outwardly relative to said center axis substantially at center of said first discharge electrode portion, and guide recesses are formed in the inner surfaces of said outer side wall portions to extend in parallel to said center axis to reach respective said discharge gap holes, so that when said first discharge electrode portions are inserted into said first positioning grooves, said semispherical projections are allowed to pass through said guide recesses into respective said discharge gap holes and said dust-prevention lug portions close respective said guide recesses.

4. A cathode-ray tube socket according to claim 2, wherein said grounding conductor comprises a strip-shaped connecting portion, said second discharge electrode portions are formed integrally with said strip-shaped connecting portion to extend perpendicularly thereto from one side thereof, and said dust-prevention lug portions are formed integrally with said strip-shaped connecting portion to extend perpendicularly thereto from the other side thereof in alignment with said second discharge electrode portions, respectively.

5. A cathode-ray tube socket according to claim 4, wherein each of said contact housings extends toward a rear face of said main body portion, each of said contact pieces being accommodated into one of said contact housings from the rear face of said main body portion.

6. A cathode-ray tube socket according to claim 5, wherein said cylindrical side wall portion comprises a front cylindrical side wall portion, a rear cylindrical side wall portion having an outside diameter larger than that of said front cylindrical side wall portion, and a step wall portion connecting a rear end of said front cylindrical side wall portion with a front end of said rear cylindrical side wall, said discharge gap holes are formed in said rear cylindrical side wall portion, said guide recesses extending from respective said discharge gap holes to an outer surface of said step wall portion, and said dust-preventing lug portions being held in abutment with the outer surface of said step wall portion to close respective openings defined by said guide recesses in the outer surface of said step wall portion.

7. A cathode-ray tube socket according to one of claim 2 through 6, wherein each of said contact housing has a radially outwardly enlarged portion behind said contact body, said discharge gap holes communicating directly with respective said enlarged portions, said contact portion and said first discharge portion being interconnected by a lateral extension extended perpendicularly to said central axis, an engagement recess being formed in an inner surface of said cylindrical side wall portion in confronting relation to said contact portion, said contact portion having an engagement finger raised therefrom and projecting into said engagement recess, said engagement finger and said lateral extension fixedly sandwiching an inner wall portion of said cylindrical side wall portion in a direction parallel to said center axis.

8. A cathode-ray tube socket according to one of claims 2 through 6, wherein each of said contact portions is formed in a tubular shape, a side portion of said contact portion being fitted between a projection integrally extending from an inner surface of said front face wall perpendicularly thereto and the inner surface of said cylindrical side wall confronting said side portion of said contact portion.

9. A cathode-ray tube socket according to claim 1, including a high-voltage chamber mounted on a side of said main body portion adjacent to a high-voltage contact, a pair of high-voltage discharge electrodes accommodated in said high-voltage chamber and defining therebetween a high-voltage discharge gap across which an electric discharge can occur at an overvoltage higher than a prescribed value, said high-voltage contact being connected to one of said high-voltage discharge electrodes.

10. A cathode-ray tube socket according to claim 9, wherein said high-voltage chamber is integrally formed with said main body portion and comprises a box member having a front opening and a cover member for closing said front opening, said high-voltage discharge electrodes being inserted into said box member through said front opening and extending substantially parallel to said central axis.

11. A cathode-ray tube socket according to claim 10, wherein said high-voltage contact, said high-voltage discharge electrode connected therewith, and a high-voltage terminal connected to said high-voltage discharge electrode, are constructed integrally by pressing a single metal plate.

12. A cathode-ray tube socket according to claim 11, wherein said high-voltage terminal projects forward through said cover member, including a protective cover angularly movably formed integrally with said cover member at a front side thereof for covering said high-voltage terminal projecting through said cover member.

13. A cathode-ray tube socket according to claim 11, wherein said high-voltage contact and said high-voltage discharge electrode are interconnected by a connecting portion held against a portion of said box member by a portion of said cover member.

* * * * *